US006364410B1

(12) United States Patent
Tang

(10) Patent No.: US 6,364,410 B1
(45) Date of Patent: Apr. 2, 2002

(54) COLLAPSIBLE COT

(76) Inventor: Larry Tang, 45 Park Knoll Dr., East Brunswick, NJ (US) 08816

( * ) Notice: Subject to any disclaimer, the term of this patent is extended or adjusted under 35 U.S.C. 154(b) by 0 days.

(21) Appl. No.: 09/593,938

(22) Filed: Jun. 15, 2000

(51) Int. Cl.[7] ..... A47C 4/30
(52) U.S. Cl. ..... 297/16.2; 297/45
(58) Field of Search ..... 297/16.2, 16.1, 297/45

(56) References Cited

U.S. PATENT DOCUMENTS

| | | | | | |
|---|---|---|---|---|---|
| 244,216 | A | * | 7/1881 | Fenby | 297/45 X |
| 1,027,692 | A | * | 5/1912 | Cole | 297/45 X |
| 3,124,387 | A | * | 3/1964 | Maclaren | 297/16.2 |
| 3,136,272 | A | * | 6/1964 | Sprigman | 297/16.2 X |
| 3,635,520 | A | * | 1/1972 | Roher et al. | 297/45 X |
| 4,258,951 | A | * | 3/1981 | Groom | 297/16.2 |
| 4,605,261 | A | * | 8/1986 | Lee | 297/16.2 |
| 4,671,566 | A | * | 6/1987 | Knapp et al. | 297/16.2 |
| 4,836,601 | A | * | 6/1989 | Cone | 297/16.2 |
| 5,054,849 | A | * | 10/1991 | Hoff | 297/45 |
| 5,499,857 | A | * | 3/1996 | Lynch, Jr. | 297/16.2 X |
| 5,882,068 | A | * | 3/1999 | Levine | 297/16.2 X |
| 5,893,605 | A | * | 4/1999 | Chang | 297/16.2 X |
| 5,984,406 | A | * | 11/1999 | Lee | 297/16.2 |
| 6,179,374 | B1 | * | 1/2001 | Tang | 297/45 |
| 6,209,951 | B1 | * | 4/2001 | Han | 297/45 |
| 6,231,119 | B1 | * | 5/2001 | Zheng | 297/16.2 |
| 6,237,993 | B1 | * | 5/2001 | Zheng | 297/16.2 |
| 6,247,748 | B1 | * | 6/2001 | Zheng | 297/16.2 |
| 6,247,749 | B1 | * | 6/2001 | Yu | 297/16.2 |
| 6,247,750 | B1 | * | 6/2001 | Tsai | 297/16.2 |
| 6,264,271 | B1 | * | 7/2001 | Munn et al. | 297/45 |

FOREIGN PATENT DOCUMENTS

| | | | | |
|---|---|---|---|---|
| EP | 256837 | * | 2/1988 | 297/16.2 |
| GB | 11379 | * | of 1913 | 297/16.2 |
| GB | 697539 | * | 9/1953 | 297/45 |

* cited by examiner

*Primary Examiner*—Peter M. Cuomo
*Assistant Examiner*—Rodney B. White
(74) *Attorney, Agent, or Firm*—Charles I. Brodsky

(57) ABSTRACT

A cot incorporating a frame having pairs of crossed front, rear and side legs, and with connectors for stabilizing the cot when opened and for collapsing the cot to a compact package when closed, with front pad and rear pad connectors, and with front and rear connectors being configured with generally perpendicular walls to apertures of which upper and lower ends of rear legs, front legs and side legs are pivotally connected, and with one front connector and one rear connector each including a notch within which the upper end of a front crossed leg and the upper end of a rear crossed leg are arranged to glide in opening and closing the cot, and to which an upper end of two crossing side legs are pivotally connected, for automatically folding its fabric liner as the cot is being collapsed.

13 Claims, 7 Drawing Sheets

90,92
70,72

A,B 70,72
90,92
70,72
90,92
16,24
50,54

A,B
70,72
90,92

COLLAPSIBLE COT

BACKGROUND OF THE INVENTION

1. Field of the Invention

This invention relates to foldable chairs, in general, and to a collapsible cot especially useful for casual seating, in particular.

2. Description of the Related Art

Folding or collapsible chairs in the nature of furniture have been described in such U.S. Pat. No. 3,635,520 (Roher et al) and U.S. Pat. No. 5,984,406 (Lee). In a multiple seat arrangement, they are also described in U.S. Pat. No. 5,570,928 (Staunton et al). For outdoor use, in camping and watching sports games, chairs of this type have been illustrated in U.S. Pat. No. 5,893,605 (Chang). When a reclining chair is desired for camping, hiking, fishing and concert evenings, a construction of the type shown in U.S. Pat. No. 5,882,068 (Levine) is said to be useful.

While chairs of these types may prove adequate to suit their intended purposes, a further need exists to have a folding or collapsible cot for simple use in one's backyard. Those cots (and hammocks, for that matter) that are commercially available are typically large and bulky, and once set out commonly remain in place the entire season, to suffer the travail associated with changing weather conditions.

SUMMARY OF THE INVENTION

As will become clear from the following description, a collapsible cot is provided according to the invention, to consist of a frame including two pairs of front crossed legs, two pairs of rear crossed legs, and three pairs of side crossed legs, with each pair of crossed legs being pivotally connected together where they cross. First, second and third front pad connectors are included to pivotally connect to lower ends of the front crossed legs and to individual ones of the side crossed legs—while first, second and third rear pad connectors pivotally connect to lower ends of the rear crossed legs and to individual ones of others of the side crossed legs. First, second and third front connectors pivotally connect to upper ends of the front crossed legs and to individual ones of the side crossed legs, while first, second and third rear connectors pivotally connect to upper ends of the rear crossed legs and to individual ones of others of the side crossed legs. Three rear supports extend between apertures in the three rear pad connectors and the three rear connectors, and a fabric liner is included connected to two of the front connectors and to two of the rear connectors. In completing a preferred construction, moreover, a pair of side extenders are pivotally coupled to one of the front crossed legs and to one of the rear crossed legs, where they are joined with the fabric liner for a user to rest upon.

In accordance with the invention, to provide strength and reliability of operation, the front connectors where the two side extenders couple include a top surface having a notch therein open at one end and slightly larger than the diameter of the crossed legs when composed as a tubular configuration, a first wall at an underside thereof defining one side of the notch and to which the upper ends of the crossed legs are connected, along with a second wall at the underside, generally perpendicular to the first wall and combined therewith, to which the upper ends of the others of the crossed legs are also pivotally connected. In like manner, each of the remaining pad connectors include the two generally perpendicular walls for fastening with their respective pivotally connected legs—while the rear pad connectors include apertures at the joins of the walls where the rear supports are fixed.

As will also become clear, in one embodiment of the invention, the side extenders are each pivotally coupled to their associated front crossed leg and to their rear crossed leg at a point below the connector which joins them, whereas in a second embodiment, the sides extenders are pivotally coupled at a point above the connectors. In this first embodiment, various taps, fasteners, and overlying rings are employed to align the crossed legs and extenders together, and to secure them in position; in the second embodiment, hinges are employed to achieve this comparable result.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
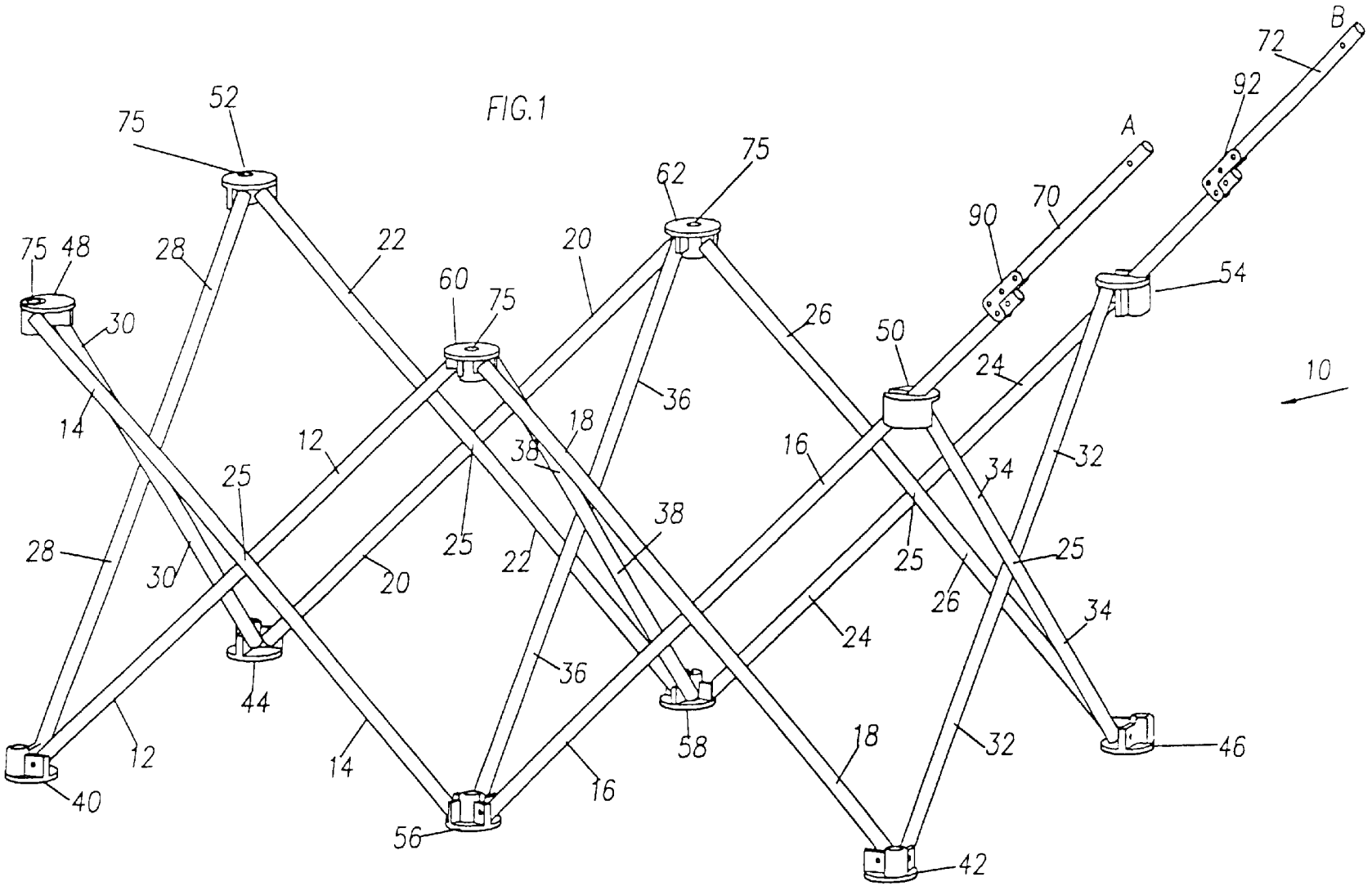
FIG. 1 is a front perspective view of the collapsible cot of the invention in an unfolded position, with its seating fabric removed.
Figures 2A, 2B, 2C, 2D, 2E, 2F:
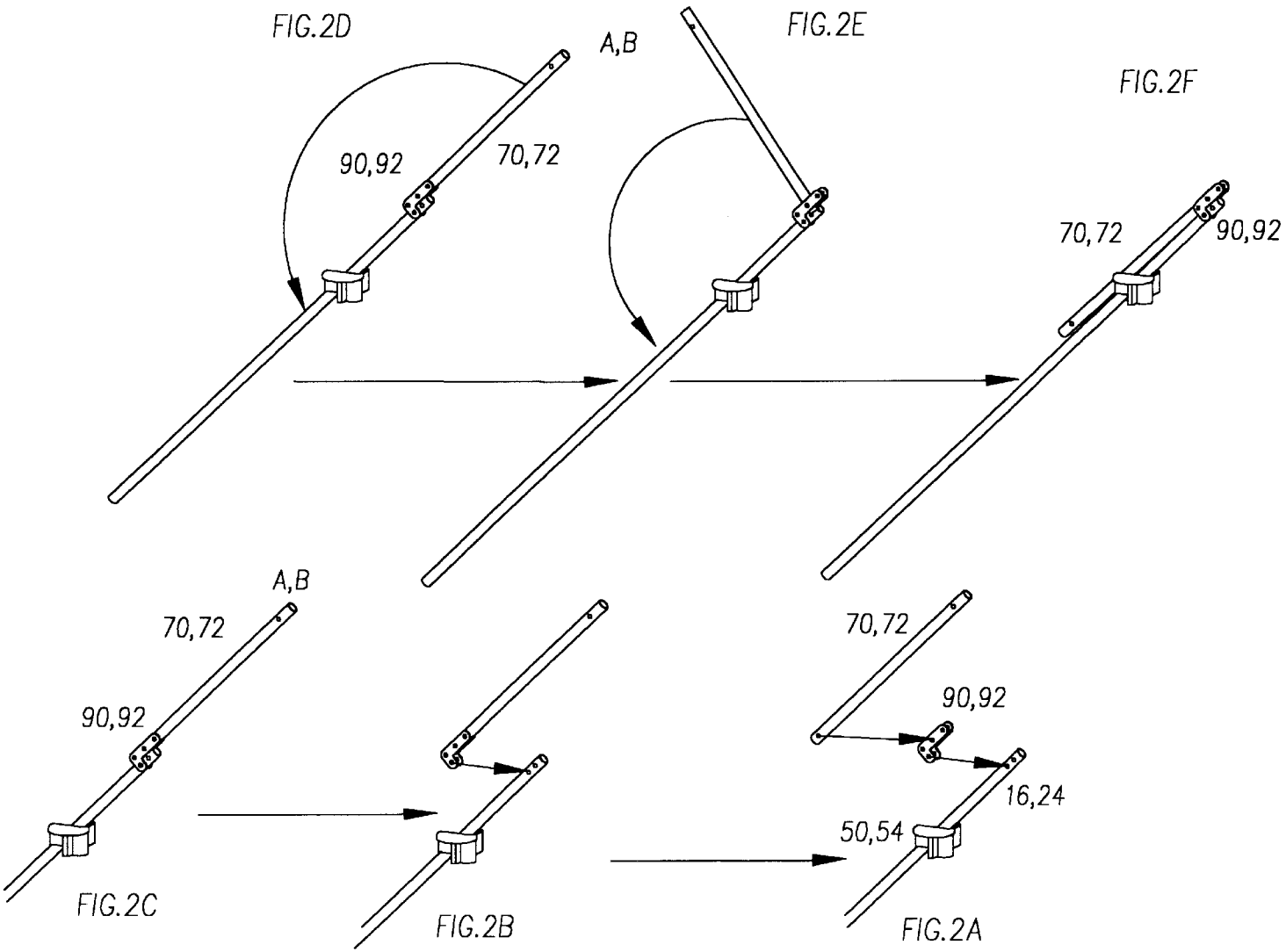
FIGS. 2A–2F are helpful in an understanding of the operation of the embodiment of FIG. 1.
Figure 5B:
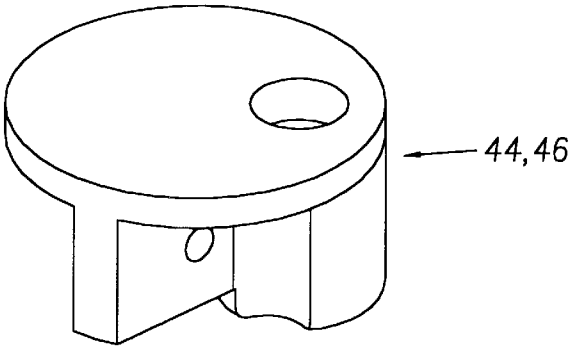
FIG. 5A & 5B are top and bottom perspective views, respectively, of two of the three rear pad connectors of the invention.
Figure 5A:
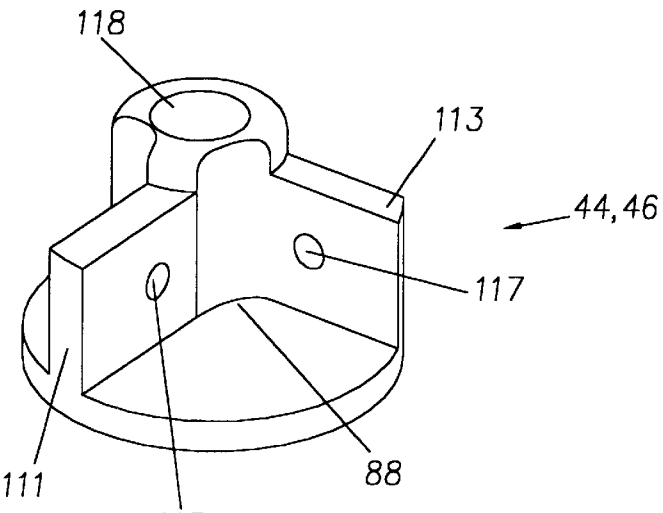
Figure 3B:
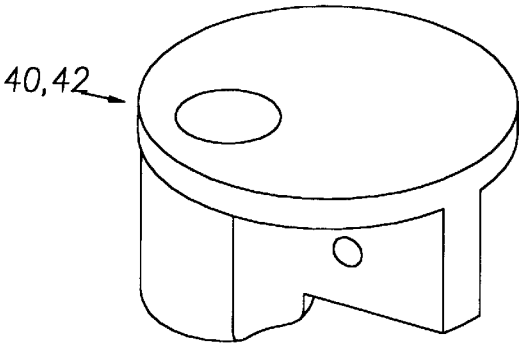
FIGS. 3A & 3B are top and bottom perspective views, respectively, of two of the three front pad connectors of the collapsible cot of the invention.
Figure 3A:
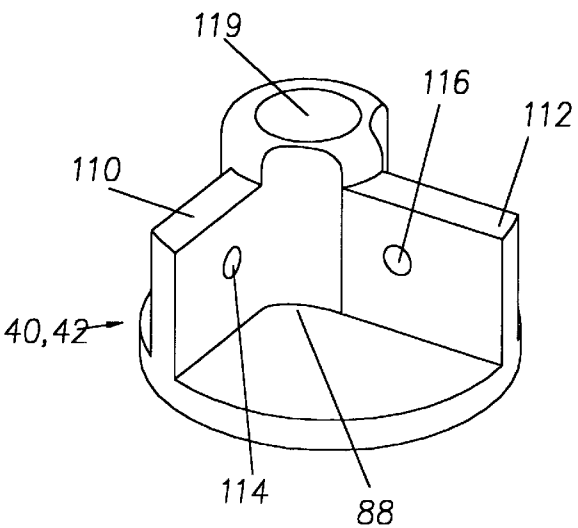
Figure 4B:
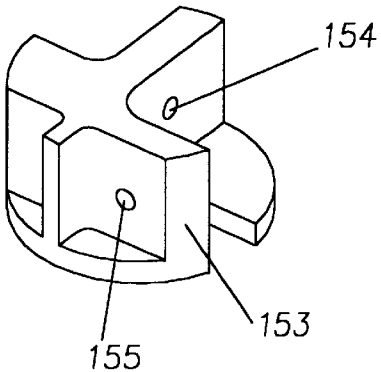
FIG. 4A & 4B are top and bottom perspective views, respectively, of a first front connector of the invention.
Figure 6B:
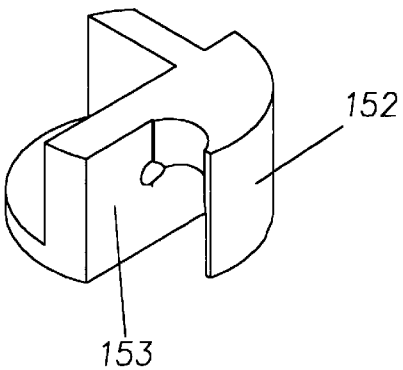
FIGS. 6A & 6B are top and bottom perspective views, respectively, of a first rear connector of the invention.
Figure 4A:
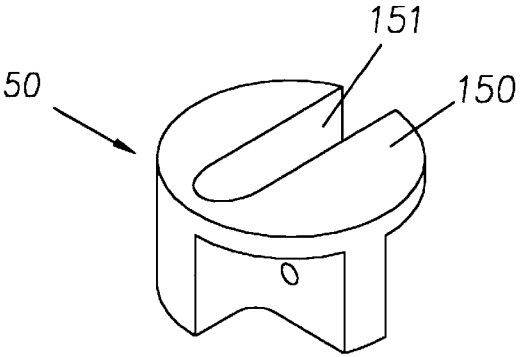
Figure 6A:
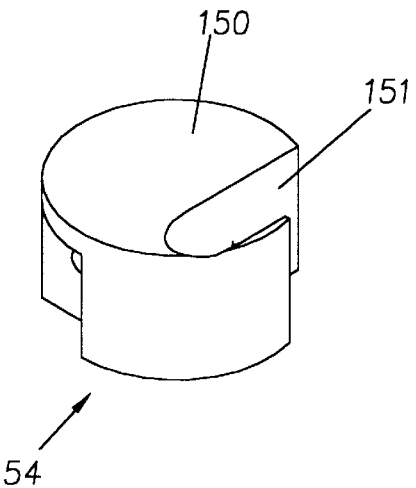
Figure 10B:
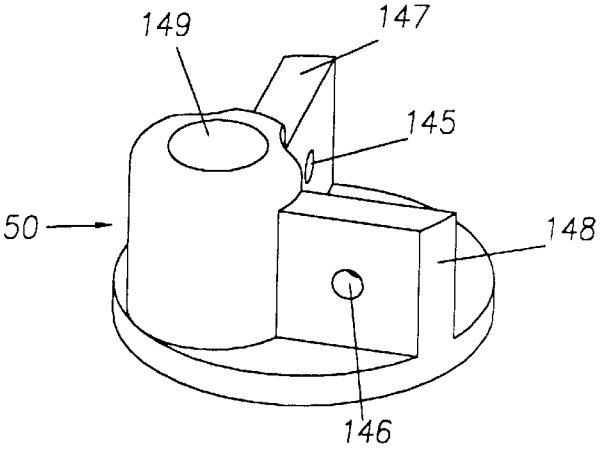
FIG. 10 illustrates the embodiment of the collapsible cot of FIG. 8 with the seating fabric in place, but is also helpful in an understanding of the installation of the seating fabric in the embodiment of FIG. 1.

As with the folding chair of U.S. Pat. No. 5,984,406, the collapsible cot of the present invention is constructed out of tubular members. In particular, the frame of the cot 10 includes a first pair of front crossed legs 12, 14, a second pair of front crossed legs 16, 18, a first pair of rear crossed legs 20, 22, a second pair of rear crossed legs 24, 26, a first pair of side crossed legs 28, 30, a second pair of side crossed legs 32, 34, and a third pair of side crossed legs 36, 38. As illustrated, each of the pairs 12 & 14, 16 & 18, 20 & 22, 24 & 26, 28 & 30, 32 & 34, and 36 & 38 are joined together by pivot pins 25. The crossed legs 12 & 14, 16 & 18, 20 & 22, 24 & 26, 28 & 30, 32 & 34 and 36 & 38 are tubular, and are constructed of aluminum or steel.

A first front pad connector 40 pivotally connects to lower ends of the front crossed leg 12 and the side crossed leg 28, while a second front pad connector 42 pivotally connects to lower ends of the front crossed leg 18 and the side crossed leg 32. A first rear pad connector 44 pivotally connects to the lower ends of the rear crossed leg 20 and the side crossed leg 30, while a second rear pad connector 46 pivotally connects to lower ends of the rear crossed leg 26 and the side crossed leg 34. A first front connector 48 pivotally connects to the upper ends of the front crossed leg 14 and the side crossed leg 30 while a second front connector 50 pivotally connects at an upper length of the front crossed leg 16 and to the upper end of the side crossed leg 34. A first rear connector 52 pivotally connects to the upper ends of the rear crossed leg 22 and the side crossed leg 28, while a second rear connector 54 pivotally connects at an upper length of the rear crossed leg 24 and to the upper end of the side crossed leg 32.

In accordance with a preferred embodiment of the invention, a third front pad connector 56 is included, pivotally connected to the lower ends of the front crossed legs 14 & 16 and to the lower end of the side crossed leg 36. A third rear pad connector 58 similarly is pivotally connected to the lower ends of the rear crossed legs 22 & 24, and to the lower end of the side crossed leg 38. A third front connector 60 pivotally connects to upper ends of the front crossed legs 12 & 18, and to the upper end of the side crossed leg 38. A third rear connector 62 then pivotally connects to the upper ends of the rear crossed legs 20 & 26, and to the upper end of the side crossed leg 36.

To complete the configuration of the frame 10, a first side extender 70 pivotally couples to the front crossed leg 16 along its upper length, while a second side extender 72 pivotally couples to the rear crossed leg 24 along its respective own upper length.

Figure 10:
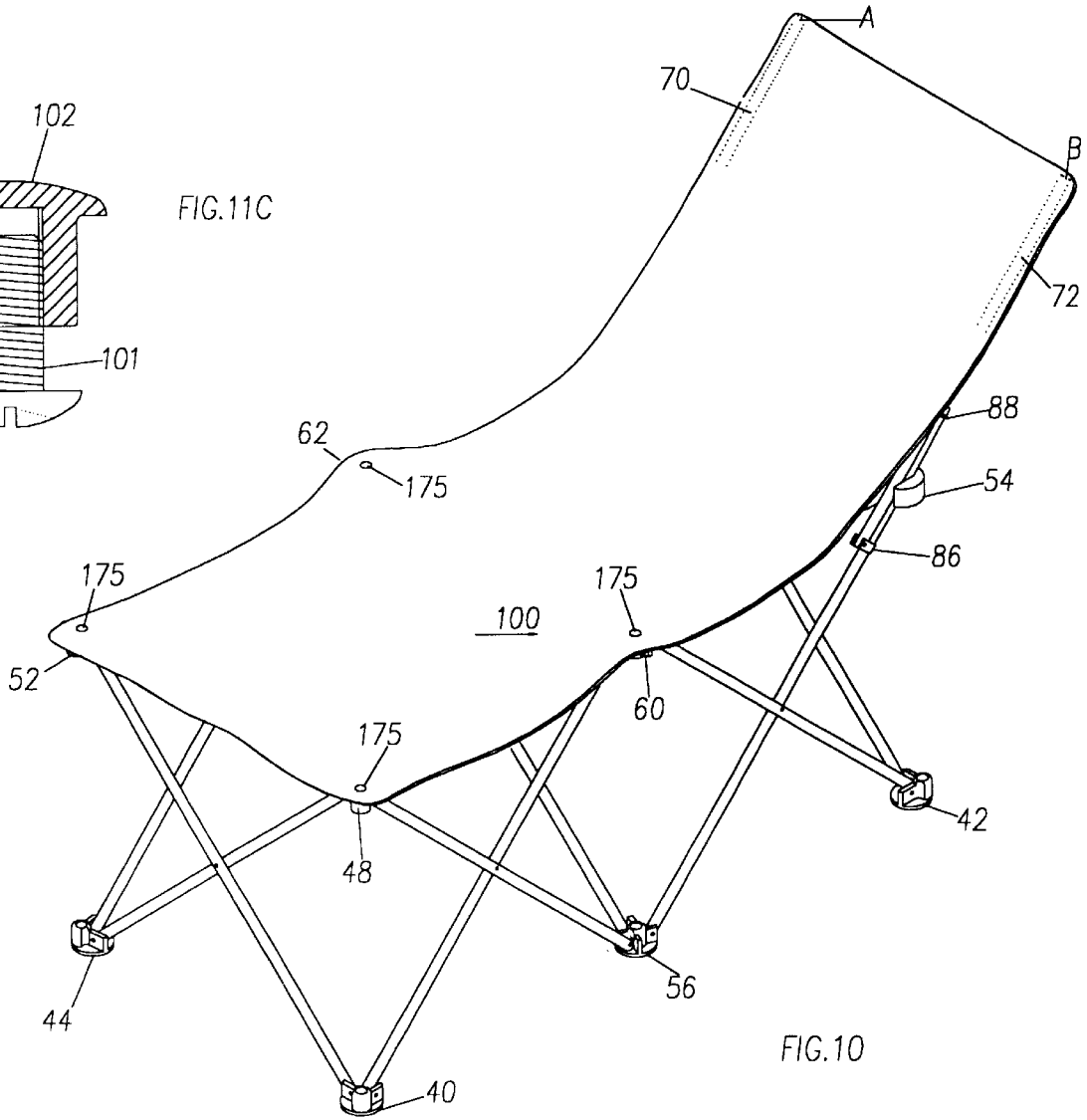

As illustrated in FIG. 10, a fabric liner 100 is connected to the front connectors 48 and 60 and to the rear connectors 52 and 62 and to fit over and around the upper ends A, B, of the side extenders 70, 72—both for this embodiment of the invention and for a second embodiment to be described below.

Figure 11C:
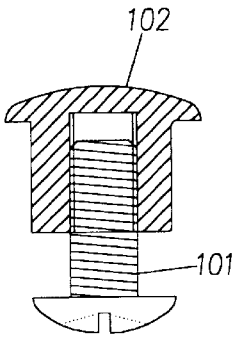
FIGS. 11A, 11B and 11C are sectional views helpful in understanding one manner of securing the seating fabric as a liner for the collapsible cot of FIG. 1.
Figure 11B:
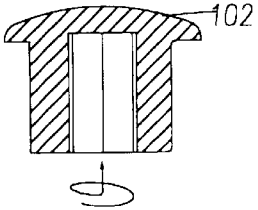
Figure 11A:
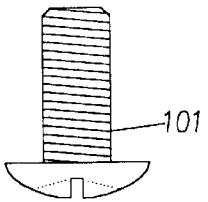

In FIG. 1, the side extenders 70, 72 are shown pivotally coupled to the front crossed leg 16 and to the rear crossed leg 24 at a point above the second front connector 50 and the second rear connector 54, respectively. FIGS. 2A–2F illustrate the pivotal coupling of the two side extenders 70, 72 to their respective front and rear crossed legs 16, 24 by means of a hinge pin 90, 92, for example, in the manner noted in FIGS. 2A–2C, and rotatable from its open position of FIG. 2D through its immediate position shown in FIG. 2E to its folded position of FIG. 2F, when it is desired to collapse the frame 10 of the cot. The end of the extenders 70, 72 to which the fabric liner 100 secures when in place is again indicated at A, B. FIGS. 11A–11C in this respect illustrate sectional views of a manner of securing the fabric liner 100 to the front connectors 48, 60 and to the rear connectors 52, 62, by means of a bolt 101, for example, extending through apertures 175 in the liner 100 overlying each of the four connectors at such point, to seat within a cap 102 which fits substantially flat there against the top surface of the liner 100.

Figure 9A:
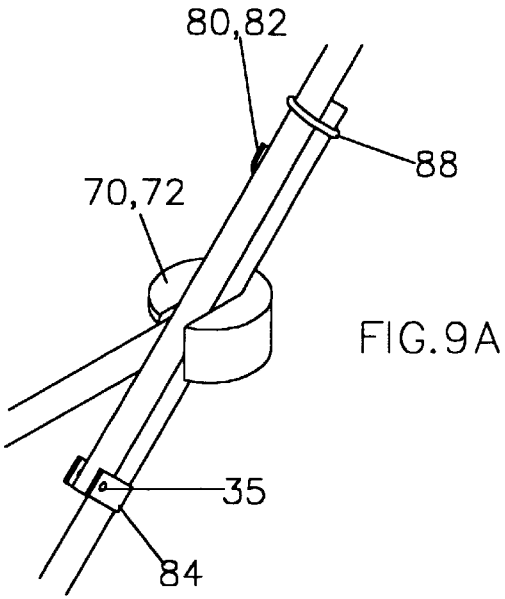
FIGS. 9A & 9B are views helpful in an understanding of the alternative embodiment of FIG. 10.
Figure 9B:
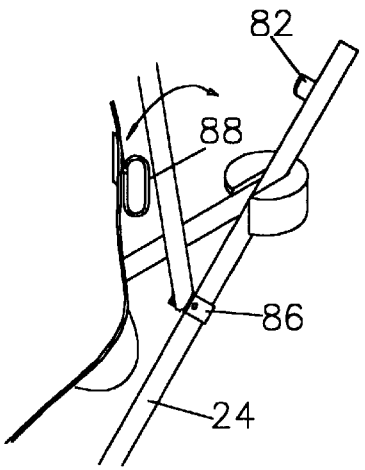
Figure 8:
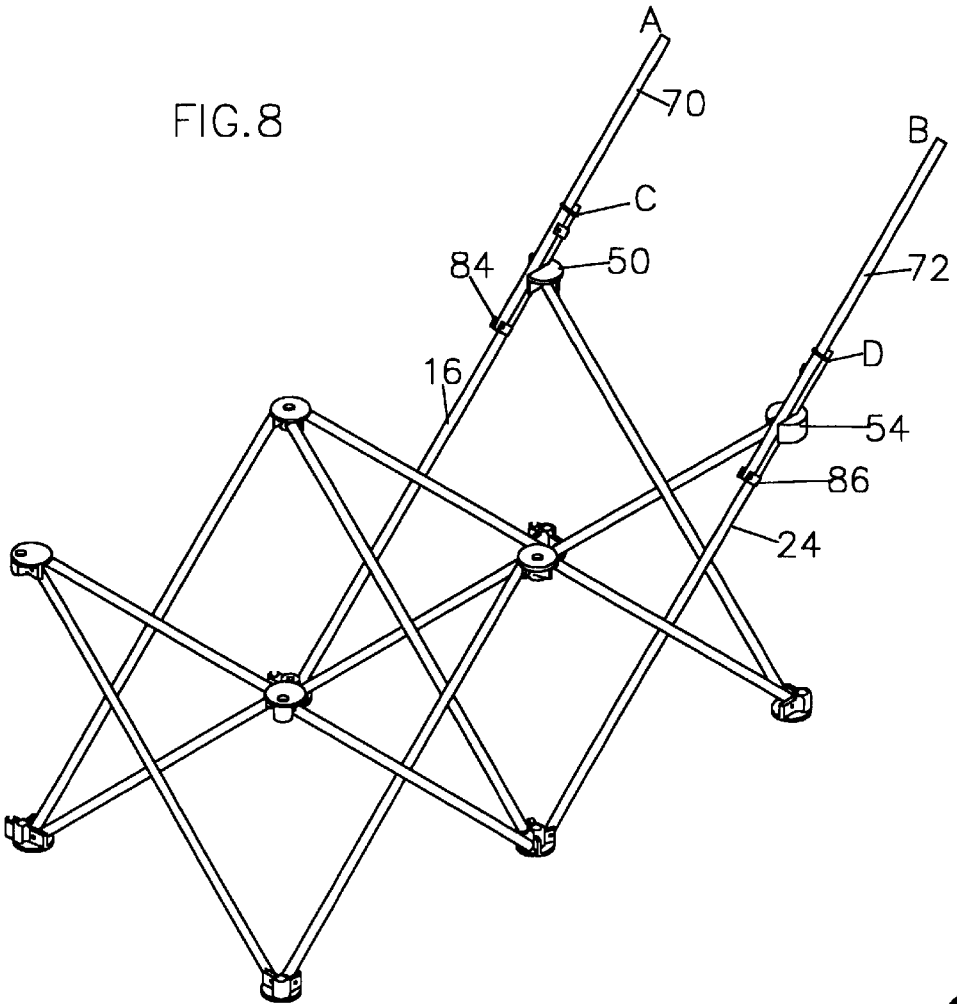
FIG. 8 is a front perspective view of the collapsible cot of the invention also in an unfolded position with its seating fabric removed, constructed in accordance with a second embodiment.

FIG. 8, on the other hand, shows an alternative embodiment in which the side extenders 70, 72 are each pivotally coupled to the front crossed leg 16 and to the rear crossed leg 24 at a point below the second front connector 50 and below the second rear connector 54, respectively, instead of above those connectors as in FIG. 1. As shown in FIGS. 9A and 9B, the embodiment of FIG. 8 is one in which a first bracket 84 is included at a point below the second front connector 50 while a similar second bracket 86 is included at a point below the second rear connector 54. As illustrated more particularly in FIG. 9B, the two side extenders (70 on the one hand, and 72 on the other), are pivotally coupled to the brackets 84, 86, by a pin 35 to permit the pivoting of the side extenders 70, 72, about both the front crossed leg 16 and the rear crossed leg 24. Each of the brackets 84, 86 typically may be composed of steel, welded to the crossed leg 16 (or 24 as the case may be), to receive and join with the respective extender 70, 72. As FIGS. 9A and 9B further show, a first tap 80 is provided along the upper length of the front crossed leg 16 while a second such tap 82 is provided along the upper length of the rear crossed leg 24, to allow for positioning of the side extenders 70 and 72, respectively, in fixing the position of the side extender with its respective crossed leg.

FIG. 9B further shows a fastener 88 at left and right undersides of the fabric 100, near its top end, at a position to overlie the side extender and its adjacent crossed leg, for securing the respective extender and leg together. Thus, those points labelled C and D in FIG. 8 illustrate the locations where the fasteners 88 of the fabric 100 secure in holding the side extender 70 to the crossed leg 16 and the side extender 72 to the crossed leg 24—with the fastener 88 being in the form of a steel ring when the crossed legs 16, 24 and the side extenders 70, 72 are tubular. FIG. 10, in this respect, shows this alternative embodiment of the invention with the fabric liner 100.

Particularly referring to FIGS. 1, 8, 10, 3A & 3B, the lower end of the front crossed legs 12 & 18 are fastened by rivet or other pivot manner to the front wall 110 of the front pad connectors 40, 42, shown as having a generally perpendicular side wall 112, the fastener passing through its aperture 114. Similarly, the lower end of the side crossed legs 28 & 32 is also fastened by rivet or other pivot to the wall 112 by means of its aperture 116. As illustrated, both front pad connectors 40, 42 are identical, with the lower end of the front crossed leg 12 being pivoted on one surface of the front wall 110 on one connector 40, 42, with the lower end of the front crossed leg 18 being on the opposite surface of the front wall 110 of the other connector 40, 42, and with the lower ends of the side crossed legs 28 and 32 being pivoted on opposing faces of the side wall 112.

In like manner, referring to FIGS. 1, 8, 10, 5A & 5B, the lower end of the rear crossed legs 20 & 26 and the lower ends of the side crossed legs 30 & 34 are fastened by rivets or other pivots to the rear pad connectors 44, 46. Each of the connectors 44, 46 include their own pairs of generally perpendicular walls and their own apertures. Thus, and as indicated, the lower end of the front crossed leg 20 is fastened by pivot or otherwise to rear pad connector 44 at one surface of the wall 111 by aperture 115 while the lower end of leg 26 is fastened by pivot or otherwise to one surface of the wall 113 by aperture 117. Correspondingly, the lower end of the side crossed leg 30 is fastened to the opposing surface of wall 111 via aperture 115 while the lower end of the side crossed leg 34 is fastened to the opposing surface of wall 113 via aperture 117. An aperture 118 is included at the joins of the walls 111 & 113 of the connectors 44, 46, while a similar aperture 119 is included at the join of the walls 110 & 112 of the connectors 40, 42, to allow for a common construction of these front and rear pad connectors and an interchangeability of components, although such apertures 118 and 119 at these connectors are not needed for the operation of the collapsible cot.

Figure 7B:
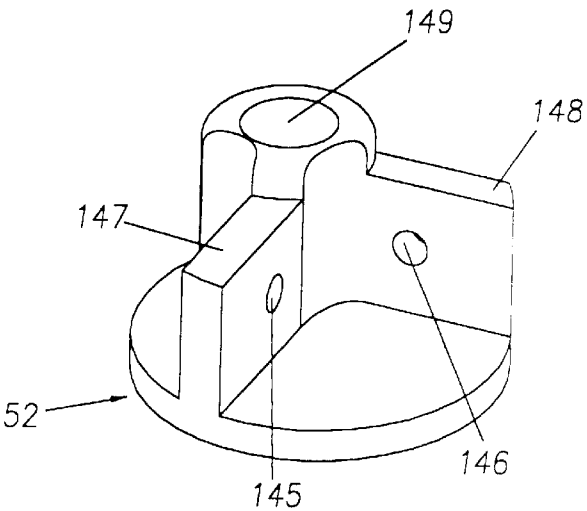
FIGS. 7A & 7B are top and bottom perspective views, respectively, of a second front connector and of a second rear connector of the collapsible cot of the invention.
Figure 10A:
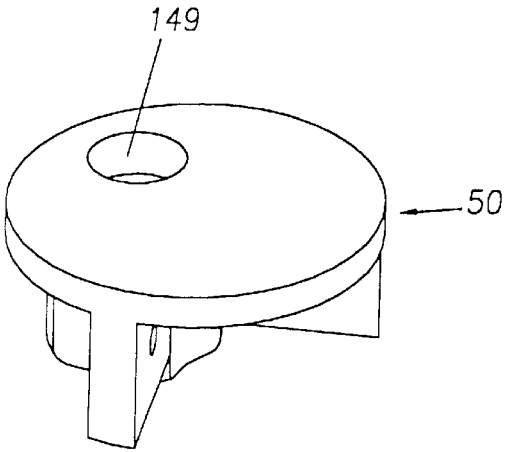
Figure 7A:
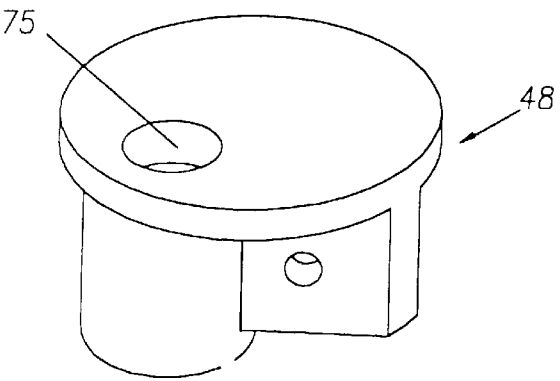

As an examination of FIGS. 1 and 10 will show, the front connector 48 may be constructed identical to the rear connector 52—with the structure of these two connectors having generally perpendicular side walls to which the upper ends of the front crossed leg 14 and the side crossed leg 30 are pivoted on the one hand with respect to the front connector 48, and to which the upper ends of the rear crossed leg 22 and the side crossed leg 28 are likewise pivotally connected with respect to the rear connector 52 on the other hand, This is shown in FIGS. 7A & 7B where the perpendicular side walls are shown at 147, 148, and where the aperture is shown at 149. The pivot connections for the legs are through the apertures 145, 146.

The third front pad connector 56 is similarly constructed comparable to the third front connector 60 in having yet a further perpendicular wall so as to receive three sets of legs instead of the two sets as with the front pad connectors 40 and 42—pivotally receiving the lower ends of the front crossed legs 14 & 16 and the lower end of the side crossed leg 36. Correspondingly, the third front connector 60 receives at its three perpendicular walls, the pivot connections of the front crossed legs 12 & 18 and the upper end of the side crossed leg 38. The third rear connector 62, on the other hand, includes the same three perpendicular walls to receive, in pivot connections, the upper ends of the rear crossed legs 20 & 26 and the side crossed leg 36—with its own further aperture. In such manner, the rear pad connector 58 and the rear connector 62 may be mirror images of one another, just as are the front pad connector 56 and the front connector 60. As will be appreciated, each of the connectors 48, 52, 60 and 62 are provided with apertures 75 as indicated in FIGS. 1 and 8 to receive the bolt 101 and cap 102 of FIGS. 11A, 11B & 11C in holding the fabric liner 100 in place.

To complete the construction of the preferred embodiments of the invention, the upper end of the side crossed leg 32, is fastened along the upper length of the rear crossed leg 24 on the rear connector 54 in a manner identical to that by which the upper end of the side crossed leg 34 is fastened along the upper length of the front crossed leg 16 in the front connector 50. Such connectors 50 and 54 are illustrated in FIGS. 4A & 4B and 6A & 6B, respectively—with the configurations of FIGS. 4A and 4B receiving the legs 16 and 34, and with the configurations of FIGS. 6A & 6B receiving the legs 24 and 32. As shown, the connectors 50, 54 include a top surface 150 having a notch therein 151 open at one end, understood to be slightly larger than the diameter of the crossed legs 16, 24 when composed as a tubular configuration. This dimensioning allows the legs 16, 24 to glide easily within the notch 151 as the cot is folded closed or opened. As more particularly shown in FIGS. 4B and 6B, the front connector 50 and the rear connector 54 further include a first wall 152 at an underside defining one side of the notch 151 and to which the legs 16 and 24 are fastened. At the same time, the connectors 50 and 54 include a second wall 153 at the underside, generally perpendicular to the wall 152 in combination therewith, to which the upper ends of the side crossed legs 34 and 32 are fastened. In similar manner, both perpendicular walls 152 and 153 are provided with apertures 154, 155 for fastening with their respective pivotally connected legs.

To collapse the opened cot of FIGS. 1 and 8, all that is needed is for one to push forward the side extenders 70, 72 to the upper ends of the front crossed leg 16 and the rear crossed leg 24. The legs 16, 24 readily slide within the notch 151, and the pivot connections of all the legs to opposing faces of the perpendicular walls reliably collapses the frame to a compact configuration. Then, in a collapsed condition, the cot can be simply carried to wherever it may be placed for storage. As will be appreciated, the collapsing of the cot will be understood to fold the fabric liner 100 inwardly and out of the way at the same time, yet without it having to be removed from the side extenders 70, 72.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. A collapsible cot comprising:

a frame including a first pair of front crossed legs (12), (14), a second pair of front crossed legs (16), (18), a first pair of rear crossed legs (20), (22), a second pair of rear crossed legs (24), (26), a first pair of side crossed legs (28), (30), a second pair of side crossed legs (32), (34), and a third pair of side crossed legs (36), (38), with each pair of crossed legs being pivotally connected together where they cross, and with each leg of all said pairs of legs having an upper and a lower end;

a first front pad connector (40) pivotally connected to lower ends of said front crossed leg (12) and said side crossed leg (28);

a second front pad connector (42) pivotally connected to lower ends of said front crossed leg (18) and said side crossed leg (32);

a first rear pad connector (44) pivotally connected to lower ends of said rear crossed leg (20) and said side crossed leg (30);

a second rear pad connector (46) pivotally connected to lower ends of said rear crossed leg (26) and said side crossed leg (34);

a first front connector (48) pivotally connected to upper ends of said front crossed leg (14) and said side crossed leg (30);

a second front connector (50) pivotally connected at an upper length of said front crossed leg (16) and to an upper end of said side crossed leg (34);

a first rear connector (52) pivotally connected to upper ends of said rear crossed leg (22) and said side crossed leg (28);

a second rear connector (54) pivotally connected at an upper length of said rear crossed leg (24) and to an upper end of said side crossed leg (32);

a third front pad connector (56) pivotally connected to lower ends of said front crossed legs (14) and (16) and to the lower end of said side crossed leg (36);

a third rear pad connector (58) pivotally connected to lower ends of said rear crossed legs (22) and (24) and to the lower end of said side crossed leg (38);

a third front connector (60) pivotally connected to upper ends of said front crossed legs (12) and (18), and to the upper end of said side crossed leg (38);

a third rear connector (62) pivotally connected to upper ends of said rear crossed legs (20) and (26), and to the upper end of said side crossed leg (36);

a first side extender (70) pivotally coupled to said front crossed leg (16) along said upper length of said leg (16);

a second side extender (72) pivotally coupled to said rear crossed leg (24) along said upper length of said leg (24);

and a fabric liner connected to said front connector (48), to said front connector (60), to said rear connector (52), to said rear connector (62), and to said side extenders (70), (72) at upper ends thereof.

2. The collapsible cot of claim 1 wherein said side extenders (70), (72) are each pivotally coupled to said front crossed leg (16) and to said rear crossed leg (24) at a point below said second front connector (50) and below said second rear connector (54), respectively.

3. The collapsible cot of claim 2, also including a first bracket (84) at a point below said second front connector (50), and a second bracket (86) at a point below said second rear connector (54) whereat said side extenders (70), (72) pivotally couple to said front crossed leg (16) and to said rear crossed leg (24), respectively.

4. The collapsible cot of claim 3 wherein each of said first bracket (84) and said second bracket (86) is composed of steel, welded to said front crossed leg (16) and to said rear crossed leg (24), respectively.

5. The collapsible cot of claim 2, also including a first tap (80) along the upper length of said front crossed leg (16), and a second tap (82) along the upper length of said rear crossed leg (24), each to locate said side extenders (70) and (72), respectively, in position for connection to said fabric liner.

6. The collapsible cot of claim 5, additionally including a first fastener (86) on said fabric liner overlying side extender (70) at said front crossed leg (16), and a second fastener (88) on said fabric liner overlying said side extender (72) at said rear crossed leg (24), and each for securing the respective extender and leg together.

7. The collapsible cot of claim 6 wherein said first and second fasteners (86), (88) comprise a steel ring when said front crossed leg (16), said rear crossed leg (24), and said side extenders (70), (72) are composed as a tubular configuration.

8. The collapsible cot of claim 1 wherein said side extenders (70), (72) are each pivotally coupled to said front crossed leg (16) and to said rear crossed leg (24) at a point above said second front connector (50) and above said second rear connector (54), respectively.

9. The collapsible cot of claim 8, also including a first hinge (90) at a point above said second front connector (50), and a second hinge (92) at a point above said second rear connector (54), where said side extenders (70), (72) pivotally Couple to said front crossed leg (16) and to said rear crossed leg (24), respectively.

10. The collapsible cot of claim 1 wherein said second front connector (50) and said second rear connector (54) each include a top surface having a notch therein at one end and slightly larger than the diameter of said front crossed leg (16) and of said rear crossed leg (24), respectively, when composed as a tubular configuration.

11. The collapsible cot of claim 10, wherein said second front connector (50) and said second rear connector (54) each include a first wall at an underside thereof defining a first side of said notch and to which said upper ends of said front crossed leg (16) and said rear crossed leg (24) are pivotally connected, and a second wall at said underside, generally perpendicular to said first wall and combined therewith, to which said upper ends of said side crossed legs (32) and (34) are pivotally connected.

12. The collapsible cot of claim 11 wherein each of said first and second front pad connectors (40), (42) and each of said first and second rear pad connectors (44), (46) include a pair of generally perpendicular walls for fastening with their respective pivotally connected legs.

13. The collapsible cot of claim 12 wherein each of said third front pad connector (56) and said third rear pad connector (58) also include a pair of generally perpendicular walls for fastening with their respective pivotally connected legs.

* * * * *